United States Patent [19]

Baker

[11] Patent Number: 4,477,080

[45] Date of Patent: Oct. 16, 1984

[54] BOARD GAME DEVICE HAVING PLURAL TIERS

[76] Inventor: Bruce W. Baker, Clarksville Rd., Clarksville, Ohio 45113

[21] Appl. No.: 451,064

[22] Filed: Dec. 20, 1982

[51] Int. Cl.[3] ..... A63F 3/00

[52] U.S. Cl. ..... 273/241; 273/248

[58] Field of Search ..... 273/241, 248, 249, 242, 273/243, 250, 251, 254

[56] References Cited

U.S. PATENT DOCUMENTS

| | | | |
|---|---|---|---|
| 1,095,934 | 5/1914 | Seed | 273/249 |
| 3,371,931 | 3/1968 | Saunders | 273/249 |
| 4,026,557 | 5/1977 | Le Brun | 273/243 |
| 4,030,762 | 6/1977 | Gilmore | 273/248 |
| 4,093,235 | 6/1978 | Barry | 273/354 |
| 4,099,723 | 7/1978 | Robinson | 273/241 |
| 4,341,388 | 7/1982 | Carter | 273/248 |

FOREIGN PATENT DOCUMENTS

| | | | |
|---|---|---|---|
| 1100319 | 9/1955 | France | 273/264 |
| 21018 | of 1912 | United Kingdom | 273/249 |

*Primary Examiner*—Richard C. Pinkham
*Assistant Examiner*—Matthew L. Schneider
*Attorney, Agent, or Firm*—Wood, Herron & Evans

[57] ABSTRACT

A multi-tier board game arrangement is disclosed including a game board with a playing surface having a center and a perimeter, the playing surface including a plurality of segmented endless paths and interconnecting paths therebetween. Each of the segmented endless paths is generally concentric with the center of the playing surface, with the endless paths spaced radially therefrom and preferably in a regular geometric shape, such as a regular hexagon with the paths being generally centered one with another. A plurality of interconnecting or transverse paths interconnect adjacent endless paths, with a plurality of segmented home bases adjacent the center of the playing surface and connected to the endless path nearest the center. A plurality of sets of playing pieces are also included in the game board arrangement, such playing pieces each having a designated permitted movement, such as movement only in a clockwise or a counter-clockwise direction, or in both directions. Movement of the playing pieces about the playing surface is primarily provided through the chance selection of a number, movement being further augmented through the use of playing cards each bearing on the face thereof instructions relevant to the movement of a playing piece about the playing surface.

11 Claims, 4 Drawing Figures

BOARD GAME DEVICE HAVING PLURAL TIERS

FIELD OF THE INVENTION

This invention relates generally to a board game device, and particularly to a board game arrangement having a playing surface incorporating segmented paths of movement for playing pieces disposed thereon, and employing playing pieces having a particular and differing permitted movement about the segmented paths.

BACKGROUND OF THE INVENTION

It is well known in the art of making game devices of the game board variety to provide particular paths of movement, such as segmented paths, over which game playing pieces are moved. In general, the incremental movement of the game pieces about the segmented pathway provided on the game board will be determined by the roll of a die or dice, or other chance device for producing a number. In addition, board games have often incorporated playing cards which are employed in the course of playing the board game augmenting the movement of the playing pieces. Known game devices utilize various rules of play, identifying indicia for the playing pieces such as distinguishable colors, as well as particularly defined pathways which a playing piece or pieces of a set must follow in advancing from a designated starting position to a home base.

Most of such game board devices have been limited to square or otherwise rectangular game boards with the overall novelty or uniqueness of the game being present in indicia on the board associated with the paths of movement. Such board games, in general, provide for the movement of all of the playing pieces in only one direction, i.e. from a designated start forwardly to a designated finish, or for all of the playing pieces to have a common direction of permitted movement.

SUMMARY OF THE INVENTION

It is a primary object of the invention to provide a board game device. More specifically, it is an object to provide a board game device having a unique playing surface incorporating endless paths of movement interconnected by transverse paths of movement for game pieces disposed thereon.

Another object of the invention is to provide a board game device or arrangement wherein the game board playing surface includes a plurality of generally concentric interconnected paths or tiers about which game playing pieces can advance, with the particular objective of the board game arrangement being the movement of a set of playing pieces from a start located on a peripheral tier of the game board playing surface to a "home" located at or near the center of the game board surface.

Yet another object of the invention is to provide a plurality of sets of playing pieces, wherein each set is comprised of pieces which have permitted movement in a specified direction or directions, and also restricted ability to pass like pieces of the same set.

A further object is to provide for augmented movement of such playing pieces through the use of a variable factor introduced into the game arrangement in the form of playing cards bearing movement instructions thereon.

These and other objects and advantages have been accomplished in this invention in a multi-tier board game arrangement including a game board with a playing surface having a center and a perimeter, the playing surface including a plurality of segmented endless or continuous paths. Each of the segmented endless paths are generally concentric with the center of the playing surface, the paths being radially spaced therefrom. It has been found advantageous as well as entertaining to provide the endless paths in a regular geometric shape, such as a regular hexagon, with the paths being generally centered one with another, and with the hexagonal sides of each such path being in general parallelism with the respective hexagonal side of an adjacent path.

The playing surface further includes a plurality of interconnecting and transverse paths which interconnect adjacent endless paths, as well as a plurality of segmented "home bases", which also serve to interconnect the center of the playing surface and the endless path nearest the center. Each of the plural home bases bears an identifying indicium, such as a distinguishing color. The interconnecting paths, which are also formed of a plurality of segments, respectively permit movement of a playing piece from one endless path to another. The playing surface is further characterized by a designated "start" for each set of a plurality of sets of playing pieces which is located outwardly of the endless path nearest the perimeter of the playing surface. In the preferred form of the game board arrangement, a number of segments of each of the endless paths also bears a distinguishing card indicia marking thereon which, upon a playing piece alighting or landing on such segment, calls into play one of a plurality of playing cards.

The game board arrangement includes in addition to the playing surface described above a plurality of sets of playing pieces. Each set of playing pieces includes a playing piece which has permitted movement about the endless paths only in a clockwise direction, a playing piece having permitted movement about such paths only in a counter-clockwise direction, and a playing piece having permitted movement in either a clockwise or counter-clockwise direction. Each set of playing pieces bears an identifying indicium for that set, such as a distinguishing color, which corresponds to an indicium of one of the center home bases of the playing surface.

Movement of the playing pieces about the playing surface is primarily provided through the use of randomly selected numbers, such as numbers selected from the throw of a die or dice. This incremental movement of a playing piece is further augmented in a preferred embodiment of this game board arrangement through the use of at least one set of playing cards, each card bearing on a face thereof instructions relevant to the movement of a playing piece about the playing surface. As noted, a card is employed upon a playing piece landing on a card indicia bearing segment of one of the endless paths.

In the presently preferred form of the game arrangement, a playing piece of a set is placed at a designated start on the playing surface, the piece being advanced about an endless path and between endless paths via the interconnecting or transverse paths, with movement being effected in correspondence to the permitted movement of such piece and in correspondence to a randomly selected number. Movement of the piece is further augmented through the added chance factor introduced into the game arrangement presented by the instructions conveyed by a set of playing cards, the cards being employed upon the playing piece landing on a card indicia bearing segment. It is the preferred ultimate object of the game to advance an entire set of such pieces to the home base for that particular set.

Further refinements of the game board arrangement so described provide that a playing piece of a given set of pieces having permitted movement in a clockwise direction can pass any piece having permitted movement in a counter-clockwise direction, and vice versa; a playing piece having such permitted movement in a clockwise direction cannot pass another piece of the same set having permitted movement in a clockwise direction, which rule likewise holds for counter-clockwise moving pieces of the same set. The playing piece having permitted movement in both a clockwise as well as counter-clockwise direction may pass and be passed by any other piece.

Movement of a playing piece between endless paths via the transverse paths is further contingent upon and effected by the beginning of such movement originating at a segment of an endless path which is in common with an end of a transverse path. That is, a playing piece may only pass between such paths when the previous movement of the piece terminated on a segment common with an end of a transverse path. Movement of a playing piece into a home base from the endless path nearest the center is effected in a like manner.

The foregoing objectives, features, and advantages of the present invention will be more readily understood upon consideration of the following detailed description of the invention taken in conjunction with the accompanying drawings, in which:

DETAILED DESCRIPTION OF THE INVENTION

Figure 1:
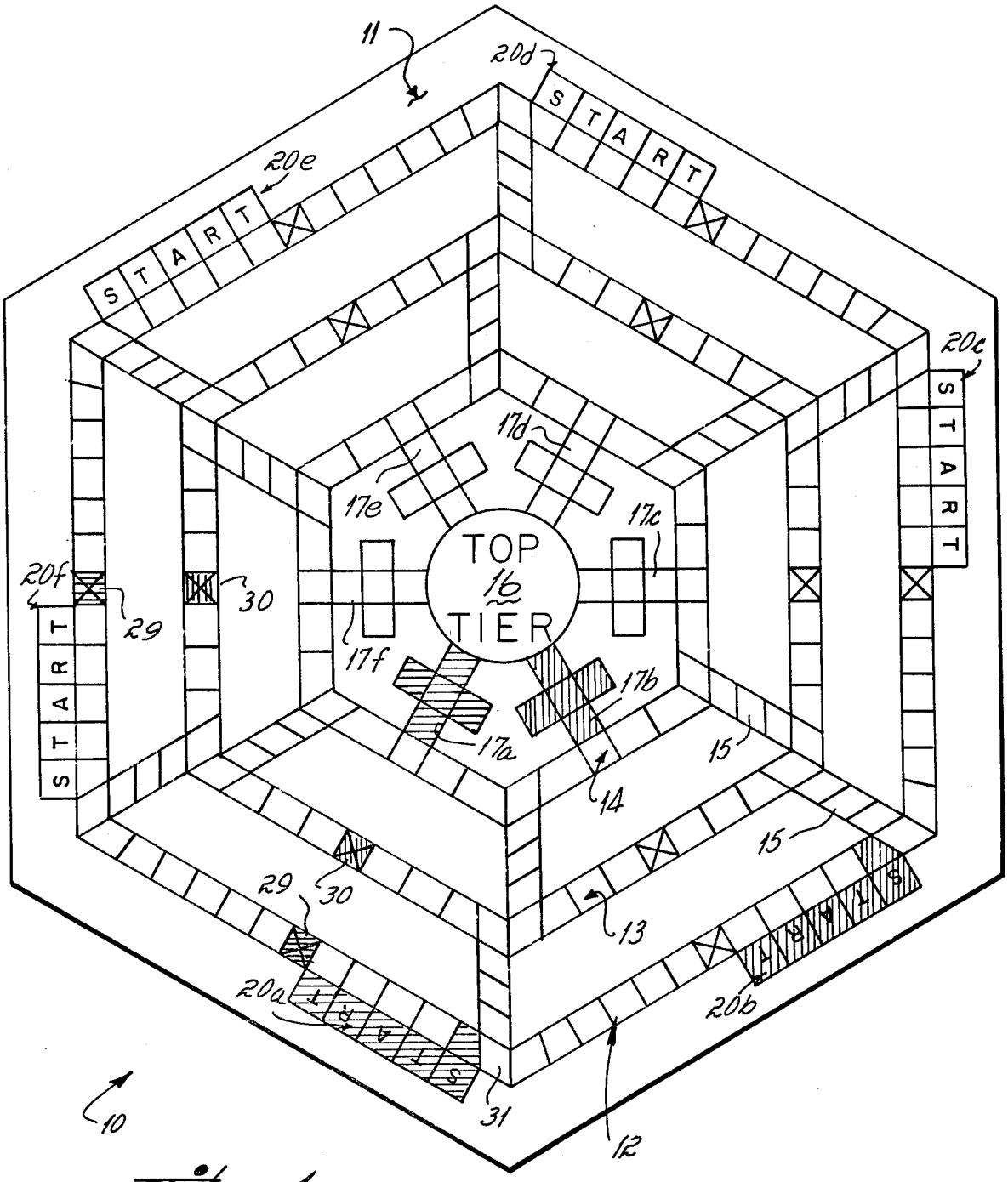
FIG. 1 is a plan view of a game board and playing surface made in accordance with the principles of this invention.

Referring now to FIG. 1, a preferred form of the game board is shown, being generally indicated at 10. The game board 10 has the shape of a regular hexagon, which has been found advantageous herein due to its eye pleasing nature as well as due to the particular adaptation of this game board arrangement for use by six players in a manner to be hereinafter described. It will of course be recognized that the peripheral shape of the game board is a matter of choice. The game board 10 may be constructed of rigid paperboard, cardboard, pressed board or other suitable material, and is generally planar in this embodiment.

The game board 10 has a playing surface generally indicated at 11. The playing surface 11 is comprised chiefly of a pattern of pathways over which a plurality of playing pieces, to be more fully described below, travel in the course of use of the game board arrangement of this invention. This pathway pattern may be formed simply by printing the pattern on the generally planar surface of the game board 10, or by imprinting the pattern on a separate paper sheet that is laminated or glued to a game board face. The surface pattern includes endless paths or tiers 12, 13, and 14 which are interconnected by interconnecting or transverse paths generally indicated at 15. All of the endless paths 12, 13, and 14 are preferably made generally concentric with the center 16 of the playing surface, which herein is an enlarged generally circular area. The endless path or tier 14 which is nearest the center area 16 is interconnected to this center area 16 by home bases 17*a–f*. The aforedescribed paths, both endless and interconnecting, and the home bases 17*a–f* are segmented, i.e. broken up into incremental units, in order to facilitate the measured movement of playing pieces about the playing surface 11: one segment or square corresponding to one unit of movement of a playing piece, for example.

The endless paths 12, 13 and 14 are each formed in a generally hexagonal pattern, and are each centered on the playing surface 11 relative to the hexagonal perimeter of the playing surface. That is, the endless paths 12, 13, and 14 are radially spaced from the center 16 with the sides of each regular hexagon formed by each endless path being generally parallel to the next outermost hexagonal path and the perimeter. Again, this particular pattern for the playing surface as well as its arrangement on the board is a matter of choice, having been found advantageous in the present embodiment due to its eye pleasing nature and its facility for use in this game board arrangement by six players.

Each of the endless paths 12, 13, and 14 represent a tier of the game board arrangement, with the outermost endless path 12 being the first tier, the next inwardly spaced endless path 13 being the second tier, and the innermost endless path 14 being the third tier. The use of three tiers for this game board arrangement has found particular advantage largely due to the relationship involved between the number and length of the tiers and the length of play required to advance a piece from the first tier 12 to a home base (17*a–f*). It will nevertheless be understood that more or fewer endless paths or tiers may be employed within the spirit of this invention.

Figure 2:
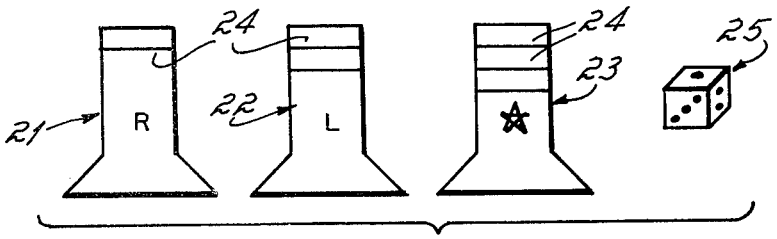
FIG. 2 is a group elevational view of each of the different pieces included in a set of playing pieces for each of the players using this game board arrangement, and a die, the die being shown in perspective.

The playing surface 11 also includes a starting area or staging area (20*a–f*) for each respective set of playing pieces which form a part of the board game arrangement, each set including the playing pieces 21, 22 and 23 as shown in FIG. 2. Each of the starting areas 20*a–f* is preferably located along the outside perimeter of the outermost and first tier 12, each starting area being associated with one side of the hexagon thus formed by the first tier 12, and regularly spaced about the first tier 12. Where, as here, five playing pieces are included in each set of playing pieces, five segments for each start (20*a–f*) are advantageously employed, one for each piece. Each of the starting areas 20*a–f* is distinguished by a unique and identifying indicium, with the home bases 17*a–f* being likewise marked with indicia corresponding to one of each of the starting areas, such as through the use of six different colors. For example, starting area 20*a* and home base 17*a* are both blue, with starting area 20*b* and home base 17*b* both red, etc. Each of the sets of playing pieces is likewise marked with an indicium corresponding to one of the starting areas and home bases. As will be made more clear in the discussion of the preferred movement of the playing pieces about the playing surface 11, a set of playing pieces will begin at a designated start corresponding to the indicium, e.g. color, for those pieces, with the object being to advance those pieces about the playing surface from the first tier 12 through to the third tier 14 and then into the appropriate colored home base (17*a–f*). It will be noted here that each home base 17*a–f* comprises five segments corresponding to the number of playing pieces of each set of playing pieces. When all of the home base segments of a player are occupied with his or her playing pieces, that player wins.

With specific reference to FIG. 2, a plurality of sets of playing pieces including the pieces 21, 22, 23 are provided for use by the game players. Each set of pieces is identified by a unique identifying indicium, such as a color, which corresponds to the indicium of a specific start (20*a–f*) and a specific home base (17*a–f*). One set of playing pieces is used by an individual player. Each set of playing pieces includes a playing piece which has permitted movement about the tiers 12, 13, and 14 only in a clockwise direction, such as the playing piece 21. The piece 21 is marked with another indicium, such as the letter "R", indicative of this permitted movement in only a right-hand or counter-clockwise direction. Each set of playing pieces also includes a playing piece which has permitted movement about the tiers 12–14 only in a clockwise direction, such as playing piece 22. Piece 22 is likewise marked with an indicium, such as the letter "L", indicative of its left-hand or clockwise permitted movement. Each set of playing pieces further includes a playing piece having permitted movement about the tiers 12–14 in either a clockwise or counter-clockwise direction, such as playing piece 23, which here bears the indicium of a star. In the preferred embodiment of this game board arrangement, each set of playing pieces is comprised of two of each of the counter-clockwise moving and clockwise moving pieces, 21 and 22 respectively, and one of the playing pieces 23 with permitted movement in either direction.

In accordance with the preferred use of these playing pieces 21, 22 and 23 in this game board arrangement, each of the playing pieces is brought into play, that is, advances from the designated start for that set of playing pieces onto the first tier 12, only upon the random selection of a number specified for that piece. For instance, playing piece 21 enters into play only upon the selection of a 1, and piece 22 upon the selection of a 2, and piece number 23 upon the selection of a 3. Each of the pieces bears a marking, such as a circumscribed line or lines 24, indicative of this initial move restriction.

Movement of the various playing pieces about the pattern of the playing surface 11 is established through the random selection of a number, such as in the conventional manner of throwing one or more playing dice, such as die 25. For example, the die 25 will be thrown at the beginning of a game player's turn, with the number showing on the upper surface of the die representative of the number of segments which a piece of that player can move, if so permitted. Alternatively, a predetermined number of dice may be thrown at the beginning of a player's turn, with the number showing on one die being applied to one piece of the players choosing, the number showing on a second die applied to another piece of the players choosing, etc.

Figure 3:
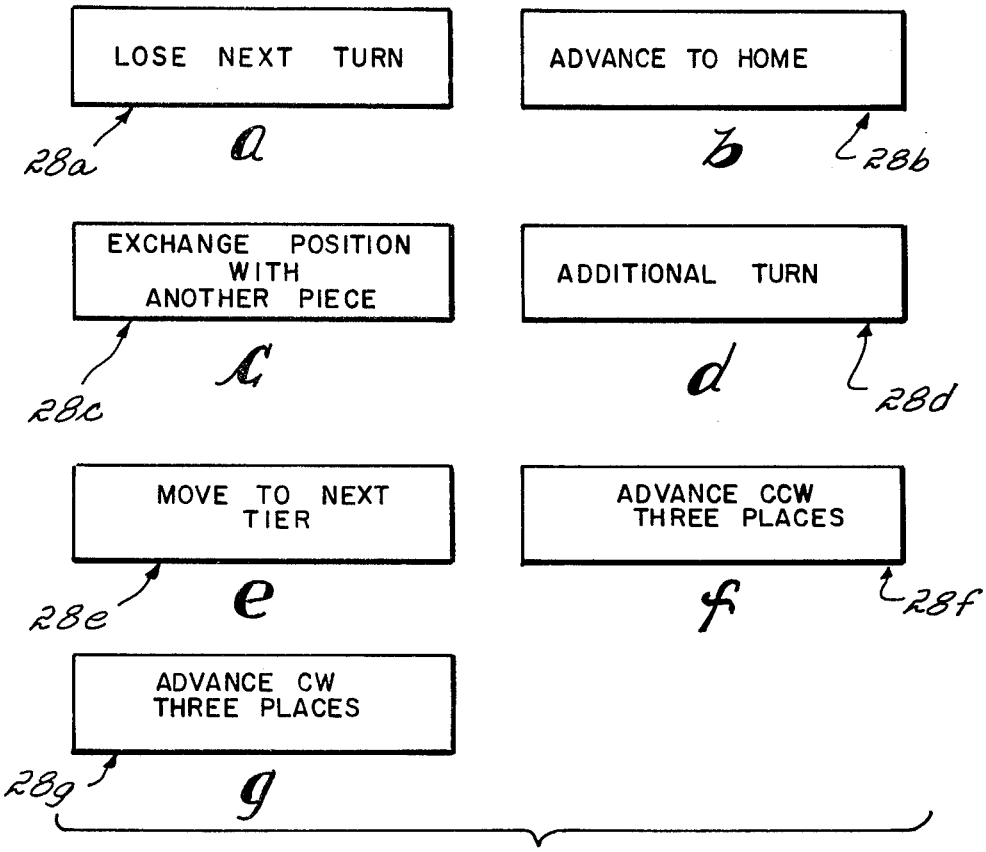
FIG. 3 (*a–g*) show plan views of various playing cards preferably included in a set of playing cards employed in the game board arrangement.

Movement of the playing pieces 21, 22 and 23 is further augmented in the preferred form of the game board arrangement through the use of playing cards, such as playing cards 28*a–g* (FIG. 3) which each bear on a face thereof instructions relevant to the movement of a particular playing piece about the playing surface. It will be recognized that the game board arrangement can be advantageously used without such cards, however. In this embodiment of the game board arrangement, a plurality of such playing cards including playing cards 28*a–g* are arranged into two decks, each deck bearing some identifying indicium thereon, such as a color designation. For instance, a deck of blue backed cards is provided for use on the first tier 12 and a second deck of red backed cards is provided for use on second tier 13. A card from one of these two decks is employed in movement, or enters into play, upon a playing piece landing at the end of its movement, as determined by the throw of a die 25, on a segment of one of the tier paths bearing a card indicia thereon, such as the blue and X marked segments 29 of first tier 12, and red and X marked segments 30 of second tier 13. For example, a playing piece landing on a blue and X marked segment 29 will thereupon be subject to the instructions of a card from the blue deck, preferably selected from the top of the deck. In this embodiment of the game board arrangement, each deck comprises about 22 cards, and contains cards substantially indicating: loss of next turn (28*a*), move to space in front of home base for that set of pieces (28*b*), trade places with a playing piece on a tier (28*c*), additional turn (28*d*) follow the permitted direction of movement for such piece and advance to a specific tier (28*e*), move counterclockwise a designated number of spaces (28*f*), and move clockwise a designated number of spaces (28*g*), for example.

The interaction between the various playing pieces as well as between the playing pieces and the pattern of the playing surface 11 is further subject to certain restrictions or rules on movement. For instance, movement of a playing piece between tiers 12, 13 or 14, exclusive of movement required by a playing card (28*a–g*), is effected only if the previous movement of a playing piece terminated on a segment of a tier 12, 13 or 14 which is common with one end of an interconnecting path, such as a transverse path 15. For instance, the previous movement of a playing piece would have had to terminate on segment 31 of first tier 12 in order for that piece to advance along transverse path 15 to second tier 13. Likewise, a playing piece must have previously terminated movement on a segment of tier 14 in common with one end of that piece's home base (17*a–f*) in order to advance into that home base. It should be noted here that a piece must have an exact count or roll to advance into place in the home base in the preferred manner of using the game arrangement.

As playing pieces move about the pattern of the playing surface, it is probable that pieces will meet. The movement of the pieces preferred herein permits a counterclockwise moving piece 21 to pass any clockwise moving piece 22 and vice versa; a clockwise moving piece 22 of a given set of pieces cannot pass another clockwise moving piece 22 of the same set, and a counter-clockwise moving piece 21 cannot pass another counter-clockwise moving piece 21 of the same set. The star designated piece 23, which can move in either direction, may pass and may be passed by any other playing piece. This designated passing movement of the pieces is superior to any instruction conveyed by a playing card (28*a–g*) which may be employed. That is, should a playing card put a specific playing piece in a position where it must pass a piece it may not so pass, the piece directed to move simply does not move.

In addition to the above described passing restrictions, only one playing piece may occupy any given segment of the pattern of the playing surface 11. Any playing piece landing, i.e. terminating its movement, on a space occupied by another piece results in the first occupant piece being returned to the designated start (20*a–f*) for that piece.

In the preferred use or operation of the game board arrangement of this invention, the object of the game is to advance all five pieces of a player's set of playing pieces 21, 22, 23 from the designated start (20*a–f*) for that set into the respective home base (17*a–f*). To commence use of the game board arrangement, each of a plurality of players chooses a set of playing pieces of a specific indicium (color) and places those pieces in the designated starting position for that set. Each player rolls a die, and the player with the highest number proceeds first. Each player gets one roll of the die 25 until a player throws a 1, 2 or 3, which respectively permits pieces 21, 22 or 23 to advance to the nearest segment of the first tier 12. That player immediately gets an additional roll or move which may be applied to the piece on the first tier 12, or to place another playing piece onto the first tier 12, if so permitted, i.e. another throw of a 1, 2 or 3. In general, a throw of the die 25 may be applied to any piece in play, where so permitted. Additionally, the star designated piece 23, which can move in either a clockwise or counter-clockwise direction, when initially placed onto first tier 12 does not result in an additional turn.

Movement of the playing pieces 21, 22, 23 about the pattern of the game board surface 11 continues from player to player, with the movement of the pieces subject to the above noted restrictions on passing, single occupancy of a path segment, movement between tiers 12, 13, 14 and into the home bases 17*a–f*, and employment of the playing cards including cards 23*a–g*. Additionally, a preferred requirement for the movement of the playing pieces is that the star designated piece 23 must be the last piece to be placed in the home base (17*a–f*).

In an alternative use of this game board arrangement, the object of the game is to advance all of a player's pieces from the designated start (20*a–f*) for that set to the center 16. The center thereby becomes the "home base" in this version of the game, with the home bases 17*a–f* serving as center interconnecting pathways for the playing pieces.

Figure 4:
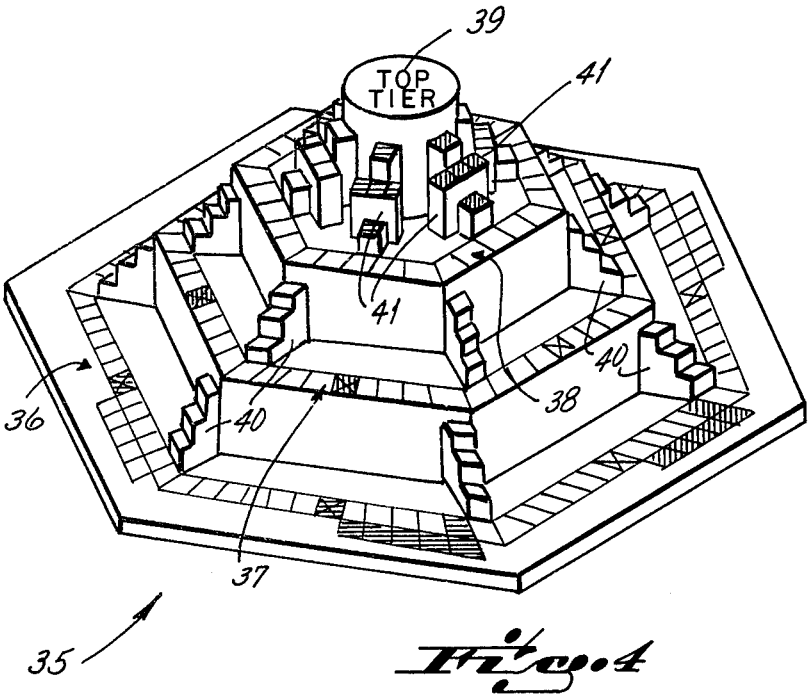
FIG. 4 is a perspective view of a three-dimensional form for a game board and playing surface made in accordance with the principles of this invention.

While the game board arrangement of this invention has been described in connection with a certain presently preferred embodiment, it will be immediately obvious to those skilled in the art that many modifications of structure, arrangement, portions, elements, materials, and components used in the practice of the invention which are particularly adapted for specific applications without departing from the principles of this invention. For example, referring to FIG. 4, a three dimensional form for a game board having a playing surface 35 is shown. This three dimensional form for the game board having a playing surface 35 is particularly characterized by first, second and third segmented and endless tiers 36, 37, 38, respectively, which are concentric with a home or center area 39, each tier being successively higher than the next outermost tier with the center 39 being the pinnacle of the playing surface 35. The interconnecting or transverse paths 40 as well as the home bases 41 are made in the form of segmented steps or stairs to facilitate movement of the playing pieces thereon. Use of this game board playing surface 35 is identical to that previously described in relation to the game board arrangement utilizing playing surface 11.

What is claimed is:

1. A board game device comprising:

a plurality of sets of playing pieces, each set bearing an identifying indicium for that set, a game board having a playing surface, the playing surface having a center and a perimeter, the playing surface including (a) a plurality of segmented endless paths, the segmented endless paths each being generally concentric with the center of the playing surface, (b) a plurality of interconnecting paths interconnecting adjacent segmented endless paths, (c) a plurality of segmented home bases adjacent the center and connected to the segmented endless path nearest the center, each of such home bases bearing an indicium corresponding to an indicium of a set of playing pieces, (d) a designated start for each set of playing pieces on the segmented endless path nearest the perimeter of the playing surface, each set of playing pieces including a playing piece bearing a first indicium restricting movement of said piece about a segmented endless path only in a clockwise direction, a playing piece bearing a second indicium restricting movement of said piece about a segmented endless path only in a counter-clockwise direction, and a playing piece bearing a third indicium allowing movement of said piece about a segmented endless path in either a clockwise or counter-clockwise direction, means for random selection of a number, a playing piece of a set placed at a designated start being advanced about segmented endless paths and between segmented endless paths via the interconnecting paths, the playing piece moving along such paths in correspondence to the permitted movement of such piece and in correspondence to a randomly selected number, the ultimate object of the game to advance an entire set of such pieces to the home base.

2. The board game device of claim 1 wherein the playing surface further includes:

a number of segments of each of such segmented endless paths bearing a card indicium marking thereon, the game board device further comprising at least one set of playing cards, each playing card bearing on a face thereof instructions relevant to the movement of a playing piece about the playing surface, movement of a playing piece being augmented through the instructions conveyed by a playing card, the card being employed upon the playing piece landing on a card indicium bearing segment.

3. The board game device of claim 2 werein the set of playing cards comprise cards bearing instructions substantially directing, respectively, loss of turn, advance to home base, exchange of position with another playing piece, additional movement in a clockwise direction, additional movement in a counter-clockwise direction, advance piece to an inner segmented endless path, advance piece to an outer segmented endless path.

4. The board game device of claim 2 wherein the playing surface has a perimeter in the shape of a regular hexagon, and wherein the playing surface includes three segmented endless paths, each of such segmented endless paths also being in the shape of a regular hexagon, each of such segmented endless paths being further generally concentric with the center of the playing surface and radially spaced apart therefrom, one of the plurality of interconnecting paths between adjacent segmented endless paths interconnecting adjacent corners of the regular hexagon paths so formed, and wherein each set of playing pieces comprises two pieces bearing said first indicium, two pieces bearing said second indicium, and one piece bearing said third indicium.

5. The board game device of claim 1 wherein the playing surface is three-dimensional, the playing surface having a center top, and a plurality of tiers generally concentric with such center top, each tier having thereon one of such segmented endless paths.

6. The board game device of claim 2, wherein the first and second indicia of said playing pieces further restrict movement of said pieces such that playing pieces of the same set bearing like indicium cannot pass each other on a path.

7. The board game device of claim 2, further including means for restricting advancement of a playing piece along the interconnecting paths and into the home base, said means comprising a segment which is in common with an end of an interconnecting path or a home base and an endless path, and which restricts advancement to pieces originating a movement from said common segment.

8. The board game device of claim 7 wherein each home base comprises a plurality of segments equal in number to the number of playing pieces in a set of playing pieces.

9. A board game device comprising:

a game board having a playing surface, the playing surface having a center and a perimeter, the playing surface including (a) a plurality of segmented endless paths, the segmented endless paths each being generally concentric with the center of the playing surface, (b) a plurality of interconnecting paths interconnecting adjacent segmented endless paths, (c) a plurality of center interconnecting paths interconnecting the center and the segmented endless path nearest the center, each of such center interconnecting paths bearing an identifying indicium, (d) a designated start for each set of a plurality of sets of playing pieces on the segmented endless path nearest the perimeter of the playing surface, a plurality of sets of playing pieces, each set bearing a set identifying indicium for that set corresponding to an indicium of a center interconnecting path, each set of playing pieces including a playing piece bearing a first indicium means for movement about a segmented endless path only in a clockwise direction, a playing piece bearing a second indicium means for movement about a segmented endless path only in a counter-clockwise direction, and a playing piece bearing a third indicium means for movement about a segmented endless path in either a clockwise or counter-clockwise direction, and means for random selection of a number, a playing piece of a set placed at a designated start being advanced about a segmented endless path and between segmented endless paths via the interconnecting paths, the playing piece moving along such paths in correspondence to the permitted movement of such piece and in correspondence to a randomly selected number, the ultimate object of the game to advance an entire set of such pieces to the center via the center interconnecting path for that set.

10. The board game device of claim 9 wherein the playing surface further includes:

a number of segments of each of such segmented endless paths bearing a card indicia marking thereon, the board game device further comprising at least one set of playing cards, each playing card bearing on a face thereof instructions relevant to the movement of a playing piece about the playing surface, movement of a playing piece being augmented through the instructions conveyed by a playing card, the card being employed upon the playing piece landing on a card indicia bearing segment, the ultimate object of the game to advance an entire set of such pieces to the center via the center interconnecting path for that set.

11. The board game device of claim 10 wherein the set of playing cards comprise cards bearing instructions substantially directing, respectively, loss of turn, advance to home, exchange of position with another playing piece, additional movement in a clockwise direction, additional movement in a counter-clockwise direction, advance piece to an inner segmented endless path, advance piece to an outer segmented endless path.

* * * * *